United States Patent [19]

Turkdogan

[11] 3,985,550

[45] Oct. 12, 1976

[54] METHOD OF PRODUCING LOW SULFUR STEEL

[75] Inventor: Ethem T. Turkdogan, Pittsburgh, Pa.

[73] Assignee: United States Steel Corporation, Pittsburgh, Pa.

[22] Filed: Jan. 23, 1975

[21] Appl. No.: 543,293

[52] U.S. Cl. ..... 75/60; 75/51; 75/52; 75/59

[51] Int. Cl.[2] ..... C21C 5/34

[58] Field of Search ..... 75/59, 60, 51, 52, 57, 75/58

[56] References Cited

UNITED STATES PATENTS

| | | | |
|---|---|---|---|
| 3,706,549 | 12/1972 | Knuppel | 75/60 |
| 3,751,242 | 8/1973 | Knuppel | 75/60 |
| 3,771,998 | 11/1973 | Knuppel | 75/60 |
| 3,802,685 | 4/1974 | Brisse | 75/60 |
| 3,844,768 | 10/1974 | Leroy | 75/59 |
| 3,885,957 | 5/1975 | Richter | 75/58 |
| 3,885,958 | 5/1975 | Grunbaum | 75/58 |

*Primary Examiner*—Peter D. Rosenberg
*Attorney, Agent, or Firm*—Forest C. Sexton

[57] ABSTRACT

A method of producing steel by the bottom blown basic oxygen process in which the residual sulfur content is reduced to an exceptionally low level. The process comprehends a standard bottom blown basic oxygen steelmaking process incorporating the injection of a gas carrying particulate desulfurizing agent to desulfurize the steel while maintaining reducing conditions in the bath.

33 Claims, 1 Drawing Figure

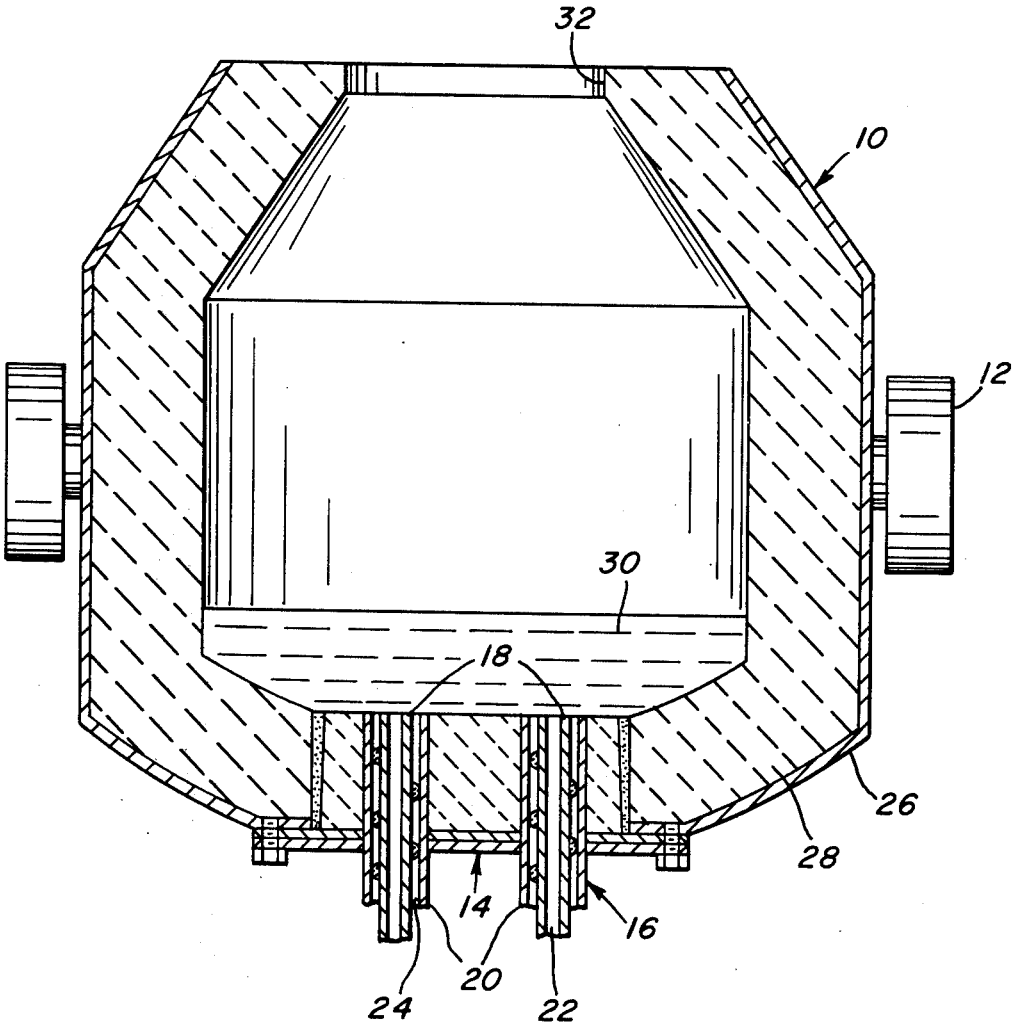
32
10
12
30
18
26
28
14
16
20
24
22

METHOD OF PRODUCING LOW SULFUR STEEL

In the bottom blown oxygen steelmaking process, which is commonly known as the Q-BOP process, a furnace, which is also referred to as a converter or vessel, includes apparatus for injecting gas beneath the surface of a bath of molten metal contained in the vessel. This apparatus includes one or more dual tuyeres for injecting oxygen surrounded by a shielding fluid into the bath. Oxygen is blown through a central tuyere and the shielding or jacket fluid which acts as a coolant is blown into the converter through an annular space or tuyere encircling the central oxygen tuyere. The jacket fluid can be any of a number of materials, such as hydrocarbons including butane, propane and natural gas.

In the bottom blown steelmaking process wherein oxygen and powdered lime are blown through the tuyeres and into the bath, the preveiling reaction mechanism is that involving the vaporization of impurities and gas-vapor phase reactions with lime in the oxidizing tuyere zone, i.e., the body of molten metal just above the tuyeres. The reaction products such as calcium silicates, phosphates and ferrites then pass through the bath and collect in the slag layer. Because the phosphorus reversion reactions, i.e., reduction of calcium phosphate by carbon in the bath, is rather sluggish, the Q-BOP process brings about dephosphorization of steel to phosphorus levels much below those expected from the composition of Q-BOP process slags low in iron oxide. Also, the slag-metal mixing in the Q-BOP process is minimal, which promotes retention of phosphorus in the slag and retards the oxidation of manganese in the steel.

The oxidizing conditions required in steel refining processes are not well suited for excessive sulfur removal from the metal. The desulfurization of steel to low sulfur levels by reaction with slag, or by direct contact of lime, can be achieved only under reducing conditions.

In open hearth steelmaking, where most of the reactions approach slag-metal equilibrium, the slag to metal sulfur distribution ratio is about 10:1. Although the refining time in the top blown basic oxygen process is much shorter than in the open hearth process, a similar sulfur distribution ratio is obtained, because of the large interfacial area in the slag-metal emulsion in the oxygen top blowing processes. In the Q-BOP process however, there is substantially less slag-metal mixing, and hence the average sulfur distribution ratio is more on the order of about 5:1. Accordingly, the slag plays a rather minor roll in desulfurizing the metal in the Q-BOP process. As a result, the Q-BOP process has not been amenable to removal of excessive quantities of sulfur.

An investigation of the desulfurizing mechanism in the Q-BOP process has shown that desulfurizing agents such as lime will readily react with and remove sulfur from the melt as long as the carbon content of the melt is above about 3 percent. Hence, desulfurization with lime or other such desulfurizing agent in the Q-BOP process is possible only during the early stages of the blow before there is appreciable carbon removal. Thus a hot metal charge containing about 0.04 percent sulfur may be dusulfurized by lime only to about 0.02 percent in the early stages of the blow, with little or no further sulfur removal in subsequent blowing stages.

It has now been discovered that more through desulfurization of the metal is possible at any carbon level if suitable desulfurizing conditions are maintained.

It is a primary object of this invention to provide a method of producing steel having an extremely low sulfur content.

It is another object of this invention to provide a method of producing bottom blown basic oxygen steel having a low sulfur content.

It is a further object of this invention to provide a bottom blown basic oxygen process for producing steel having a low sulfur content wherein desulfurization may be effected prior to, during or following decarburization.

It is still another object of this invention to provide a method for desulfurizing bottom blown steel which process suppresses phosphorus reversion.

These and other objects of my invention will become more apparent by referring to the following specification and appended drawing, in which:

The single FIGURE is a cross sectional elevation of a bottom blown oxygen steelmaking furnace suitable for practice of the invention.

Converter 10 is mounted on trunnions 12 for angular rotation to accommodate such acts as charging, turning down for sampling, making additions, pouring off slag, and tapping the finished steel itself. Converter bottom 14 is provided with tuyeres 16 formed by two concentric tubes 18 and 20. Each tuyere 16 has a central passage 22, and an angular passage 24 between tubes 18 and 20. The converter has a steel shell 26 and a refractory lining 28 for containing a molten metal bath 30. The converter is open at the top at mouth 32.

Converter 10 is charged with scrap, hot metal and other materials which are standard for charging a bottom blown oxygen converter. The heat is blown by injecting oxygen through central passage 22 of each tuyere 16 surrounds by a protective fluid which is injected through annular passage 24 of each tuyere. The protective fluid is preferably a hydrocarbon, such as natural gas, propane, butane, methane or the like. Ordinarily, lime as a finely divided particulate material is injected into the bath 30 entrained in the oxygen during at least a portion of the blow. When the carbon content of the bath has been reduced to the desired level, the heat is ordinarily tapped. Although this practice is capable of reducing carbon, phosphorus and silicon to rather low levels, sulfur, as noted above, is not greatly removed. To effect any degree of sulfur reduction, lime must be injected early in the blow before the carbon content is reduced below about 3 percent. Even then, the desulfurization reaction is limited to a short duration, so that only modest sulfur reductions are achieved.

The primary concept of this invention is to modify the blowing practice so as to prolong conditions favorable to desulfurization or subsequently create such conditions at any carbon content. Further considerations of the desulfurization mechanism in the Q-BOP process has revealed that the steel is directly desulfurized by lime only under reducing conditions. This explains why desulfurization is effected only at high carbon contents in conventional blowing practice. This result is demonstrated by considering the following equation:

$$CaO(S) + S = CaS + O \qquad (1)$$

for which the equilibrium constant at 1600°C is [%0]/[%S] = 0.036. Therefore the metal may be dusulfurized to a level of, for example, 0.02 percent sulfur when the oxygen content (activity) is about 7 to 8 ppm. Such a low level of oxygen activity in conventional Q-BOP blowing practice, will prevail in the bath only during the early stages of the blow while carbon content is rather high, i.e., about 3 percent or higher. At such high carbon contents, the carbon consumes practically all of the blown oxygen. During this time, wthen with very little free oxygen available for other reactions and considerable silicon still present in the bath, the bath is indeed reducing in nature. However, by the time the bath carbon content has been reduced to below 3 percent, much of the silicon has also been removed, and hence considerable free oxygen becomes available to render the bath oxidizing in nature, whereby sulfur can no longer be reacted and removed by lime.

Accordingly, the basic concept of this invention involves the addition of a desulfurizing blow to the conventional Q-BOP blowing practice. In essence, there are two basic embodiments of the invention, one involves desulfurizing the bath at any time during the process, but particularly at carbon contents below 3 percent, wherein a particulate desulfurizing agent, such as lime and/or calcium carbide, and a finely divided strong deoxidizing agent, such as aluminum, zirconium, titanium or rare earth alloys, are simultaneously injected into the bath entrained in an inert gas blow. The deoxidizing agent deoxidizes the bath to render reducing conditions so that the desulfurizing agent will react with and remove sulfur from the bath. The other embodiment involves desulfurizing the bath during the early stages of the process before the carbon content of the bath has been reduced to 3 percent. In this embodiment, the original reducing conditions are prolonged by injecting a particulate desulfurizing agent with an inert carrier gas blow with or without oxygen. Since the bath already contains sufficient carbon and silicon to render the necessary reducing conditions, a deoxidizing agent is not necessary in this embodiment. Furthermore, since oxygen is not being blown, or blown at a lesser rate, this reducing condition can be maintained until the bath has been desulfurized to the final desired level.

The first embodiment described above involves charging a Q-BOP vessel in accordance with conventional practice with scrap and a hot metal containing carbon, silicon and sulfur which are to be removed therefrom. The bath is then blown with shielded oxygen according to conventional practice to remove carbon, silicon and other impurities such as phosphorus. At some point during this process after the carbon content of the bath has been reduced to a value below 3 percent, an inert carrier gas such as argon or nitrogen is substituted for the oxygen and preferably, also for the shielding gas. Blown into the bath with the inert gas is a particulate desulfurizing agent and a finely divided strong deoxidizing agent. As noted above, the deoxidizing agent will deoxidize the bath to create reducing conditions so that the desulfurizing agent will react with and remove sulfur from the bath.

The inert gas injected during the desulfurizing step may be any inert gas such as argon or nitrogen. Since the inert gas serves only as a carrier for the desulfurizing and deoxidizing agents, the flowing rate thereof should be minimized in the interest of economy. Therefore, a "soft blow" is preferred, i.e., a low pressure, low volume inert gas blow in which the total fluid pressure is just sufficient to overcome the ferrostatic pressure to get the reactants into the bath and prevent entry of molten metal into the tuyeres. In addition, a soft blow will serve to minimize slag-metal mixing to prevent any possible phosphorus reversion from the slag to the metal.

Although it can be said that a soft blow is preferred for any of the embodiments of this invention, other processing parameters are not so readily definable, but may vary widely depending upon the specific reagents used, the various side reactions, the final product sought and the amount of sulfur to be removed. For example, it has already been noted that the desulfurizing step may be performed at any point during the total refining process, e.g., it may be performed initially before any carbon is removed, in which a deoxidizing agent is not necessary, mid-way through the decarburizing blow or as a final blow after all carbon and other impurities have been removed. The determining factor here will depend primarily upon economics and the final product sought. For example, if the final product sought is an aluminum-killed steel, then obviously, there would be an advantage in performing the desulfurizing step as a final step since the essential deoxidation step would serve to kill the steel. On the other hand, if a rimming steel is sought, then obviously there would be an advantage in desulfurizing the bath at some interval other than as a final step so that the steel will not be in a deoxidized condition when finished. For example, desulfurization could be effected mid-way through the decarburizing blow so that the final decarburizing blow will return oxygen to the steel. To illustrate another example, the final steel sought may be a high carbon steel in which case it would be advisable to desulfurize first and then blow oxygen with a conventional "catch-carbon" practice.

In line with the above considerations, it may be noted that although nitrogen may be a most suitable inert gas for early desulfurizing practices, it may not be desirable to use nitrogen when desulfurizing is the final step. That is to say, using nitrogen as the inert gas will of course cause nitrogen to be dissolved into the bath. Such nitrogen will however be readily flushed from the bath by any subsequent oxygen or argon blowing.

As noted above, if the desulfurizing blow is effected initially before any substantial amounts of carbon and silicon are removed from the bath, the bath is sufficiently reducing in nature that a deoxidizing agent need not be included in the blow. Indeed, the bath is so reducing in nature that oxygen may even be included in the blow. Hence, desulfurization and decarburization may be effected simultaneously, at least down to about 3 percent carbon. Although this dual reaction could be effected without using any inert gas, i.e., a conventional Q-BOP blow with lime, at carbon levels above 3 percent, the inert gas is nevertheless necessary to retard the decarburization rate, so that the sulfur can be removed before the bath becomes oxidizing in nature. It should be noted that since oxygen can be included in such an initial desulfurizing blow, and since the inert gas may be nitrogen, then obviously, air can be used. For such practice however, it is preferable to use air diluted with nitrogen. For intermediate and final desulfurizing practices, i.e., desulfurizing after carbon has been reduced below 3 percent, reducing conditions in the bath must be artificially maintained by injecting a strong deoxidizing agent. To minimize the amount of such deoxidizing agent used therefore, oxygen should not be blown in this practice, at least in any appreciable amounts.

The amount of reagents used will depend of course on which reagents are used and the side reactions which may result. For example, when desulfurizing with lime and deoxidizing with aluminum, it is known that the deoxidation product, alumina, will react with lime to form calcium aluminate. Such a reaction may be represented by the following equation:

$$4CaO + 2Al + 3S = 3CaS + CaAl_2O_4 \quad (2)$$

In the presence of solid CaO, CaS and $CaAl_2O_4$ the temperature dependence of the equilibrium constant is given by $$\log [\% \text{ Al}]^2[\% \text{ S}]^3 = -47{,}200/T + 14.99 \quad (3)$$

At 1600°C, the product is $[\% \text{ Al}]^2[\% \text{ S}]^3 = 6.2 \times 10^{-11}$. Therefore, under equilibrium conditions the steel desulfurized to 0.01 percent by powdered lime plus aluminum injection will contain residual 0.008 percent Al in solution in the steel. Assuming that the equilibrium conditions are reached and lime and aluminum utilization is 100 percent, the theoretical minimum quantities required to remove 0.01 percent sulfur are: 2.3 lb. CaO and 0.6 lb. Al per pound of sulfur removed.

If there is partial equilibrium, that is CaS and $Al_2O_3$ are formed, one should consider the reaction of Equation (1) coupled with aluminum deoxidation $$2Al + 3O = Al_2O_3 \quad (4)$$

For this reaction the equilibrium solubility product at 1600°C is $[\%Al]^2[\%O]^3 = 77 \times 10^{-14}$. In this case the residual aluminum in solution in steel would be 0.04 percent for steel desulfurized to 0.01 percent S.

Although it was noted above that desulfurizing agents other than lime may be used, lime may be perferred in some commercial Q-BOP facilities because most such facilities are already equipped with means for selectively including lime into the blow. On the other hand, the use of calcium carbide as a total or partial substitute for lime will afford some advantages because calcium carbide will more quickly desulfurize the bath, and because the desulfurizing reaction is exothermic, desulfurizing with calcium carbide will add heat to the bath. This can be demonstrated by the following reaction:

$$CaC_2 + S \rightarrow CaS + 2C \quad (5)$$

which has a heat of reaction of −5.6 kcal/mole S. Indeed, one of the problems associated with desulfurizing with lime alone is that prolonged blowing therewith in an inert gas, will overcool the bath. This can be a problem particularly in an early desulfurizing practice wherein a considerable amount of scrap has been charged and the bath, prior to decarburizing is typically at a temperature of from 1330° to 1380°C. The ideal practice of course is to selectively mix lime and calcium carbide in order to achieve the desired thermal response. For example, in an early desulfurizing practice wherein the bath temperature is rather low, it would be preferable to inject a mix heavy in calcium carbide, while on the other hand, in a late desulfurizing practice after the bath has been decarburized wherein the bath temperature may be rather high, it may be preferable to inject a mix heavy in lime. On the other hand, if it is preferred to use lime only for any reason, then the adverse effect of cooling can be compensated for by other practices. For example, desulfurization may be effected in more than one step. That is to say, one could provide a desulfurizing blow early in the process and only partially desulfurize the bath in order to avoid overcooling. Then after a subsequent oxygen blow to decarburize the bath wherein the bath temperature is again raised, a second desulfurizing blow could remove the remainder of the sulfur.

Although the desired thermal response may indeed be controlled by proper selection or admixture of lime and calcium carbide as noted above, there are other ways of controlling temperature throughout the process. For example, the possible overcooling problem associated with a lime-inert gas blow may be at least in part overcome by reducing the amount of charged scrap or by including a small amount of oxygen in the inert gas blow. As in any steelmaking process, the amount of scrap charged is of course limited to an amount insufficient to cause adverse overcooling. Hence, the cooling characteristics of a desulfurizing blow can readily be overcome by charging proportionally less scrap. As above noted, there is an alternative in that incorporating a small amount of oxygen into the inert gas blow will provide some heating as a result of oxidation reactions. It is essential of course that the oxygen blow rate must be insufficient to destroy reducing conditions necessary to maintain the desulfurizing reactions. In addition, if oxygen is incorporated into the inert gas desulfurizing blow, it will be necessary to confine the oxygen to the central tuyere outlet and blow a protective jacket fluid through the annular outlet. It is also obvious that any combination of the above techniques may be used to maintain the desired temperatures.

While on the subject of temperature it should be noted that the maximum extent of sulfur removal is inversely proportional to bath temperature. Hence, the lower the bath temperature, the lower the final surfur content. Therefore, if exceptionally low sulfur levels are desired, it is preferable to desulfurize at a point in the process wherein bath temperature is at a minimum, provided of course measures are taken as noted above to avoid overcooling. Normally, the lowest bath temperature is early in the process just after the scrap has been melted but before any appreciable carbon has been oxidized. Although there is very little sulfur reversion from the slag due to the limited mixing of slag and metal, it is none the less advisable to de-slag the bath after an early desulfurizing blow if an exceptionally low sulfur content is desired. This will not only serve to prevent sulfur reversion, but phosphorus reversion as well if the deslagging step is timed to correspond to the minimum phosphorus content in the bath, usually early in the oxygen blow.

With reference to the deoxidizing agent, it was noted above that any strong deoxidizing agent such as aluminum, zirconium and/or rare earths can be used. For economic considerations however, aluminum is usually preferred. Although weaker deoxidizing agents such as silicon could be used, such deoxidizers are too weak for optimum results and must be provided in excessive quantities. As already noted however, the presence of silicon and carbon in the bath in the amounts usually present before there is any appreciable decarburization, are sufficient to maintain the necessary reducing conditions for effective desulfurization. Hence, early desulfurizing practices, before any appreciable decarburization, will usually be successful without injecting any deoxidizing agent.

In view of the fact that injection of a deoxidizing agent may be practiced according to some embodiments of this invention, it becomes apparent that it is possible to produce a killed or semi-killed steel in the Q-BOP vessel itself, or in the alternative a rimming steel, depending upon when the desulfurizing step is performed. For example, if the desulfurizing step is performed early in the process so that oxygen blowing for decarburization follows, then the steel will normally contain sufficient oxygen to render it rimming in nature, as is the usual practice. In accordance with this invention however it does become possible to produce a killed steel in the vessel by effecting the desulfurizing step as a final step. That is, a final desulfurizing step incorporating the necessary deoxidizing agent to create reducing conditions will naturally deoxidize the steel to a fully killed condition. In the absence of any further oxygen blowing, the steel will retain the killed condition if not exposed to ambient atmospheres for a prolonged period.

In still another embodiment of this invention, it has been found that the desulfurization of the bath by lime and/or calcium carbide is favored in the presence of silicon in addition to reducing conditions. The reaction in this case is:

$$2CaO + S + \tfrac{1}{2}Si = CaS + \tfrac{1}{2}Ca_2SiO_4. \quad (6)$$

It is believed that the kinetics of the desulfurization reaction is enhanced by the formation of an intermediate product SiS which is volatile and thus provides a more rapid transfer of the sulfur reactant, than through the more conventional transfer from metal to lime particle. To take advantage of this one may inject ferrosilicon concurrently with the desulfurizing and deoxidizing agents or use an aluminum-silicon alloy.

The above reaction (equation 6) exemplifies the desulfurizing reaction wherein a deoxidizing agent is not simultaneously injected into the bath, i.e., an initial desulfurizing practice before there is any substantial carbon and silicon removal. Since the bath already contains silicon, it is not in fact necessary to add more silicon to gain the advantage therefrom. During such an initial desulfurizing practice, i.e., before any decarburization, equation (6), rather than equation (1) represents the most likely reaction. This desulfurizing reaction, i.e., involving silicon as well as a desulfurizing agent, is in fact slightly exothermic, having a heat of reaction of −13.5 kcal/mole S, assuming that silicon is already present in the bath at bath temperature. On the other hand, if silicon is added during an intermediate or final desulfurizing blow wherein a strong deoxidizing agent, such as aluminum, is also added, the reaction becomes:

$$4CaO + 2Al + 3Si + 3S = 3CaS + CaAl_2O_4 + 3Si. \quad (7)$$

This reaction has a heat of reaction of −59kcal/mole S, and hence is considerably more exothermic. Accordingly, injection of silicon, along with a strong deoxidizing agent, constitutes still another method for preventing an overcooling problem during desulfurization.

In view of the variety of embodiments for the practice of this invention, as described above, the exact quantities of reagents to be used cannot be readily expressed. To exemplify quantities however, it can be assumed that close to 100 percent of the reactants will be utilized in any of the above desulfurizing practices. Such an assumption is reasonable in view of the fact that the reactants are injected directly into the bath and are not likely to be lost to the atmosphere or slag. Therefore, assuming a 100 percent usage of reactants, a straight lime desulfurizing practice as expressed by equation 6 will require 3.5 pounds of lime per pound of sulfur removed. Since actual usage will be slightly less than 100 percent, it can be said that at least 3.5 pounds of lime should be added for each pound of sulfur to be removed. Using similar reasoning, the reaction of equation (8) will require at least 2.3 pounds of lime, 0.6 pounds of aluminum and 0.9 pounds of silicon for each pound of sulfur to be removed. The aluminum addition must of course be based on the bath oxygen content which will vary depending upon bath carbon content. With the above in mind, one can readily determine the amounts of reactants to be used for any practice.

As compared to a decarburizing blow, a desulfurizing blow as taught herein will be relatively short in duration. Regardless of which practice is followed, a blowing period of from 1 to 2 minutes should effect the optimum result, and prolonging the blow further, beyond about 2 minutes is of doubtful value, at least during any one blowing period.

From the above discussion, it is readily seen that the desulfurizing process of this invention may be performed in a great variety of practices, any one of which may be preferred depending upon other considerations involved. It is readily apparent that the desulfurizing blow may be performed prior to, midway through or subsequent to the decarburizing blow or any combination thereof. Deoxidizing agents may or may not be necessarily included in the desulfurizing blow depending upon the bath's oxygen activity. Lime and/or calcium carbide may be used as the desulfurizing agent depending upon the thermal response desired. In addition to controlling thermal response with suitable selection or admixtures of lime and calcium carbide, the temperatures may also be regulated by controlling the amount of charged scrap or by selectively including oxygen in the desulfurizing blow. Obviously therefore the exact blowing technique may be one of a great variety of forms.

It is believed that the above description will be sufficient to enable any operator to devise a number of suitable practices for desulfurizing steel according to this invention. To exemplify one preferred practice for producing a low-carbon, low-sulfur killed steel, one may charge a conventional Q-BOP vessel with scrap and blast furnace hot metal according to conventional practices. When the vessel is tilted upright, provide a 1 to 2 minute desulfurizing blow of essentially pure nitrogen gas containing a 3:1 mixture of calcium carbide and lime. On the basis of the bath's predetermined sulfur content, the minimum quantities of reactants used being 1.5 pounds of calcium carbide and 0.5 pound of lime per pound of sulfur to be removed. After this blow, the bath is preferably deslagged, and thereafter the bath is blown with shielded oxygen according to conventional practices to decarburize the bath. When the carbon content of the bath is reduced to the final desired level, or a few points thereabove, again providing a desulfurizing blow of argon containing lime, aluminum and silicon, using 2.3 pounds, 0.6 pounds of aluminum and 0.9 pounds of silicon per pound of sulfur removed. The aluminum will effectively kill the steel which can after a 1–2 minute blow be tapped.

I claim:

1. In the process for refining a molten iron base metal containing sulfur, silicon and carbon as impurities to be removed by refinement wherein at least one oxygen stream, surrounded by a protective jacket fluid, are blown into the bath to oxidize impurities therefrom, the improvement comprising including in said process a distinct and separate desulfurizing blow wherein an inert carrier gas is blown into the bath having a particulate desulfurizing agent suspended therein while maintaining reducing conditions within said bath.

2. A process according to claim 1 in which oxygen is admixed with said inert carrier gas and a protective jacket fluid is simultaneously injected surrounding the admixed oxygen and inert carrier gas.

3. A process according to claim 1 in which reducing conditions within said bath are maintained by performing the desulfurizing blow before the bath carbon and silicon contents have been appreciably reduced.

4. A process according to claim 1 in which reducing conditions within said bath are maintained by injecting a strong deoxidizing agent into the bath simultaneously with said desulfurizing agent.

5. A process according to claim 1 in which said desulfurizing agent is selected from the group consisting of lime, calcium carbide and mixtures thereof.

6. A process according to claim 4 in which said deoxidizing agent is selected from the group consisting of aluminum, titanium, zirconium, rare earth elements and mixtures thereof.

7. A process according to claim 1 in which said desulfurizing blow is effected for a period of from 1 to 2 minutes.

8. A method of refining a molten iron base metal bath containing sulfur, silicon and carbon as impurities to be removed by refinement, comprising:

a. blowing the bath with at least one stream of a desulfurizing treatment material injected through an injection zone extending under the surface of the bath, said treatment material comprising a solid particulate desulfurizing agent suspended in a carrier fluid selected from the group consisting of an inert gas, and mixtures of oxygen and an inert gas, the carrier fluid composition being so proportioned and the treatment material being injected at a rate and for a time sufficient to remove at least a major portion of the sulfur impurity from the molten bath while maintaining the silicon and carbon contents of the bath sufficiently high to provide a reducing condition in the bath;

b. surrounding with a protective fluid each oxygen-containing stream injected into the bath during desulfurization; and c. thereafter injecting into the bath through said zone at least one protected stream of oxygen in an amount and for a time sufficient to remove the silicon and carbon impurities to desired final levels.

9. A method in accordance with claim 8 wherein the desulfurizing agent is lime.

10. A method in accordance with claim 9 wherein at least about 0.1 percent Si is maintained in the bath until completion of the desulfurization treatment.

11. A method in accordance with claim 10, wherein desulfurization is carried out substantially to the equilibrium sulfur level in the bath in accordance with the reaction $2CaO + S + 178\ \mathbf{Si} = \mathbf{CaS} + \frac{1}{2}\mathbf{Ca_2SiO_4}$.

12. A method in accordance with claim 11 wherein the bath is de-slagged after completion of the desulfurization treatment.

13. A method in accordance with claim 8 wherein the inert gas is selected from the group consisting of nitrogen, argon and mixtures thereof.

14. A method in accordance with claim 9 wherein the carrier fluid is nitrogen.

15. A method in accordance with claim 8, wherein, after removal of carbon to a desired final level in the bath, the bath is further desulfurized by blowing into the bath through the injection zone a solid particulate desulfurizing agent and a solid particulate deoxidizing agent suspended in a carrier fluid non-reactive with the deoxidizing agent.

16. A method in accordance with claim 15 wherein the carrier fluid is an inert gas.

17. A method in accordance with claim 16 wherein the inert gas is argon.

18. A method in accordance with claim 17 wherein the desulfurizing agent is selected from the group consisting of lime, calcium carbide and mixtures of lime and calcium carbide.

19. A method in accordance with claim 18 wherein the deoxidizing agent is selected from the group consisting of aluminum, titanium, zirconium, rare earth elements and mixtures thereof.

20. A method in accordance with claim 17 wherein the desulfurizing agent is lime and the deoxidizing agent is aluminum.

21. A method in accordance with claim 20 wherein the further desulfurization treatment is carried out at a rate and for a time sufficient to reduce the sulfur content of the bath substantially to the equilibrium sulfur level in accordance with the reaction $4CaO + 2Al + 3S = 3CaS + CaAl_2O_4$.

22. A method of producing a killed, low sulfur steel comprising the method of claim 17 wherein aluminum is provided in sufficient quantity to reduce the oxygen content of the bath substantially to the equilibrium oxygen level in accordance with the reaction $2Al + 3O = Al_2O_3$.

23. A method of producing a rimming, low sulfur steel by refining a molten iron base metal bath containing sulfur, silicon and carbon impurities, comprising:

a. injecting through an injection zone extending under the surface of the bath at least one stream of oxygen surrounded by a protective fluid, and at a rate and for a time sufficient substantially to remove the silicon impurity and to reduce the carbon impurity content of the bath;

b. substituting for the oxygen an inert carrier fluid and purging the injection zone of oxygen while maintaining therein a fluid pressure sufficient to prevent entry therein of molten metal;

c. injecting into the bath through the purged injection zone and suspended in the carrier fluid a particulate solid treating material comprising a deoxidizing agent and a desulfurizing agent at a rate and for a time sufficient substantially to deoxidize and desulfurize the bath; and d. thereafter resuming the treatment of the bath in accordance with step (*a*) at a rate and for a time sufficient to reduce the carbon content of the bath to a desired final level.

24. A method in accordance with claim 23 wherein the bath is deslagged after it is deoxidized and desulfurized but before the resuming treatment of (*d*).

25. A method in accordance with claim 23, wherein the carrier fluid is selected from the group consisting of nitrogen and argon, the deoxidizing agent is selected from the group consisting of aluminum, titanium, zirconium, rare earth elements and mixtures thereof, and the desulfurizing agent is selected from the group consisting of lime and mixtures of lime and calcium carbide.

26. A method in accordance with claim 25, wherein the carrier fluid is nitrogen and the desulfurization treatment is terminated while the bath contains upwardly of about 0.1 percent carbon.

27. A method in accordance with claim 26 wherein the deoxidizing agent is aluminum and the desulfurizing agent comprises lime and calcium carbide in proportions, by parts by weight of lime to calcium carbide, of from about 3 to 1 to about 1 to 1.

28. A method in accordance with claim 27 wherein the desulfurizing agent is lime.

29. A method of producing a substantially killed, low sulfur steel by refining a molten iron base metal bath containing sulfur, silicon and carbon impurities, comprising:

a. injecting through an injection zone extending under the surface of the bath at least one stream of oxygen, surrounded by a protective fluid, and at a rate and for a time sufficient to reduce the silicon and carbon impurities in the bath substantially to desired final levels;

b. substituting for the oxygen an inert carrier fluid and purging the injection zone of oxygen while maintaining therein a fluid pressure sufficient to prevent entry therein of molten metal;

c. injecting into the bath through the purged injection zone and suspended in the carrier fluid a particulate solid treating material comprising a deoxidizing agent and a desulfurizing agent each such agent being injected at a rate and for a time sufficient substantially to deoxidize and desulfurize the bath.

30. A method in accordance with claim 29 wherein the carrier fluid is argon, the deoxidizing agent is selected from the group consisting of aluminum, titanium, zirconium, rare earth elements and mixtures thereof, and the desulfurizing agent is selected from the group consisting of lime and mixtures of lime and calcium carbide.

31. A method in accordance with claim 30 wherein the deoxidizing agent is provided in sufficient quantity to reduce the oxygen content of the bath substantially to the equilibrium oxygen level in accordance with the reaction $2Al + 3O = Al_2O_3$.

32. A method in accordance with claim 31, wherein the deoxidizing agent is aluminum and the desulfurizing agent comprises lime and calcium carbide proportions, by parts by weight of lime to calcium carbide, of from about 3 to 1 to about 1 to 1.

33. A method in accordance with claim 32, wherein the desulfurizing agent is lime.

* * * * *

UNITED STATES PATENT OFFICE

CERTIFICATE OF CORRECTION

Patent No. 3,985,550 Dated Oct. 12, 1976

Inventor(s) Ethem T. Turkdogan

It is certified that error appears in the above-identified patent and that said Letters Patent are hereby corrected as shown below:

Column 3, line 10, "wthen" should read -- then --.

line 66, "flowing" should read -- blowing --.

Column 10, line 14, "178 Si" should read -- 1/2 Si --;

Column 11, line 5 "treatment of (d)" should read -- treatment of step (d) --.

Signed and Sealed this

Fourth Day of January 1977

[SEAL]

*Attest:*

RUTH C. MASON
*Attesting Officer*

C. MARSHALL DANN
*Commissioner of Patents and Trademarks*